United States Patent [19]

Simmons et al.

[11] 3,980,233

[45] Sept. 14, 1976

[54] AIR-ATOMIZING FUEL NOZZLE

[75] Inventors: Harold C. Simmons, Richmond Heights; Robert R. Conrad, Chardon; Mihkel Orav, Euclid, all of Ohio

[73] Assignee: Parker-Hannifin Corporation, Cleveland, Ohio

[22] Filed: Nov. 24, 1975

[21] Appl. No.: 634,460

Related U.S. Application Data

[63] Continuation-in-part of Ser. No. 512,560, Oct. 7, 1974, abandoned.

[52] U.S. Cl. ..... 239/400; 239/402; 239/404; 239/406; 239/422; 239/424

[51] Int. Cl.[2] ..... B05B 7/04; B05B 7/10

[58] Field of Search ..... 239/399, 400, 402–406, 239/416.5, 418, 419.3, 419.5, 422–424, 425.5, 427, 427.3, 427.5, 428, 428.5; 60/39.74 R

[56] References Cited

UNITED STATES PATENTS

| | | | |
|---|---|---|---|
| 2,612,405 | 9/1952 | Kirschbaum | 239/404 |
| 3,050,262 | 8/1962 | Curtis | 239/400 |
| 3,310,240 | 3/1967 | Grundman | 239/406 X |
| 3,533,558 | 10/1970 | Masters | 239/404 |
| 3,684,186 | 8/1972 | Helmrich | 239/400 |

*Primary Examiner*—Robert S. Ward, Jr.
*Attorney, Agent, or Firm*—Donnelly, Maky, Renner & Otto

[57] ABSTRACT

A fuel injection nozzle for gas turbines in which atomization of the liquid fuel is accomplished by high-velocity air entering the combustion chamber, characterized by minimizing the surface area of metal in contact with the fuel during the atomization process and further characterized by designing the air passages such that a swirling motion is imparted to the air followed by an acceleration of the air stream to eliminate variations in air velocity and to maximize air velocity at the point of impact with the fuel.

19 Claims, 5 Drawing Figures

AIR-ATOMIZING FUEL NOZZLE

CROSS REFERENCE TO RELATED APPLICATION

This application is a continuation-in-part of copending application Ser. No. 512,560, filed Oct. 7, 1974, now abandoned.

BACKGROUND OF THE INVENTION

The use of high velocity air to atomize liquids, such as the production of a spray of fuel for combustion in gas turbines is well known, and the methods employed vary widely depending on the desired results in terms of fineness of atomization, the properties of the liquid fuel, the kind of penetration or dispersion of the spray cloud and the availability of air for the atomizing process.

For example, where compressed air can be supplied from an external source a device such as that disclosed in U.S. Pat. No. 3,474,970 can be employed, in which high velocity air is applied to one side of a conical fuel sheet produced by the discharge of a conventional spin-chamber or "simplex" nozzle flowing on the interior surface of a cone. The application of this principle, however, is limited to relatively low fuel flow rates and the nozzle operates as a conventional fuel pressure atomizer at high flows.

If the gas turbine is used in aircraft, the use of compressed air is generally not feasible and it is preferred to employ the air which is fed into the combustion chamber from the engine compressor to atomize the fuel. This method is disclosed in U.S. Pat. No. 3,283,502 which describes generally spreading the fuel into a thin film on a surface and atomizing the fuel sheet as it leaves the edge of this surface. U.S. Pat. No. 3,530,667 also shows the fuel being spread over a relatively large surface, with the atomizing air applied to both sides of the fuel sheet leaving the edge of the surface. Such fuel nozzles are conveniently described as the "prefilming" type. In both these cases, it is evident that the success of the atomization process can be affected by the behavior of the liquid film on the metal surface, since in general the size of drop produced is dependent on the thickness of the fuel film at the point of breakup. Variation of fuel film thickness can occur for various reasons and give rise to poor atomization performance in the following ways:

a. Viscous drag of the liquid on the surface will result in a decrease in velocity and therefore a thickening of the film. This effect obviously is aggravated by the use of a long flow path and higher fuel viscosities. The result is a general increase in drop size;

b. If the fuel is not spread evenly over the surface due to the method of introducing fuel in discrete jets then there will be locally thick regions which will result in large drops at these points;

c. If the air is in contact with the fuel film on the surface then surface waves may be produced which also cause local thickening of the film; and d. If the air in contact with fuel has an irregular velocity distribution (such as that due to wakes downstream of swirl vanes) then the fuel film will be thickened locally from this cause.

It will be seen from the above that there are certain disadvantages in the methods disclosed which can operate to give fuel atomization which is unsatisfactory under many conditions.

SUMMARY OF THE INVENTION

The purpose of the present invention, therefore, is to eliminate the causes of poor atomization performance exhibited by prior devices by a novel construction of the fuel nozzle and to offer other advantages which will be apparent from the ensuing description.

A principal object of the present invention is to eliminate the prefilming step described above and the disadvantages thereof.

Another object of the present invention is to insure even feeding of the fuel into the fuel sheet which is atomized by the high velocity air, to eliminate variations in the fuel sheet thickness.

Yet another object of the present invention is to eliminate undesirable variations in the velocity of the atomizing air.

Other objects and advantages of the present invention will appear from the ensuing description.

DETAILED DESCRIPTION OF PREFERRED EMBODIMENTS OF THE INVENTION

Figure 1:
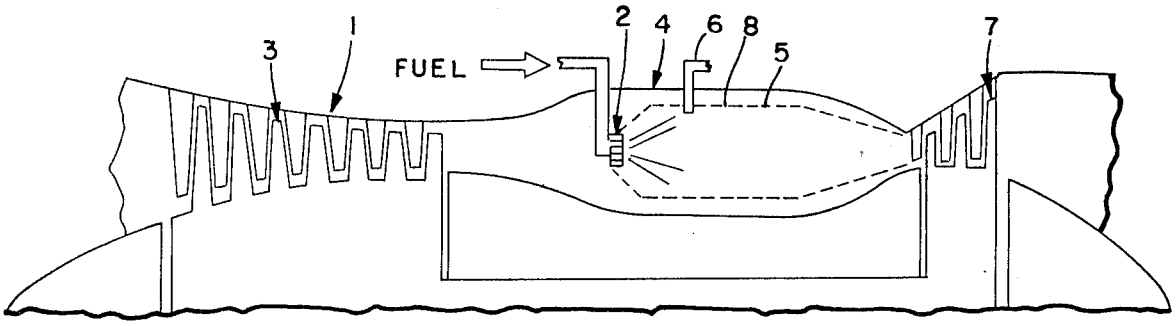
FIG. 1 is a diagrammatic cross-section view of a gas turbine employing the present fuel nozzle.

FIG. 1 is a diagrammatic cross-section of a gas turbine 1, to illustrate the general principles of operation of the air-atomizing fuel nozzle 2. Air is compressed in the engine compressor 3 and flows through the combustor 4 which contains a perforated inner liner 5 the purpose of which is to control the fuel-burning process and dilution of the combustion products. Fuel is sprayed from the nozzle 2 into the liner 5, ignited by the igniter 6 and the heated gas is expanded through the turbine 7. It will be seen that the fuel nozzle 2 is mounted in the liner 5 and therefore the air passages in the fuel nozzle are subject to essentially the same static air pressure difference as the perforations 8 in the liner 5, which means that high velocity air is available to atomize the fuel. Under running conditions the air velocity is typically about 300 ft/sec.; the air pressure difference corresponding to this velocity varies from about 0.25 to 10 p.s.i. depending on the air density in the combustor 4. While the engine is being started the air velocity is lower, but 100 ft/sec. is usually reached before ignition. The air which is used to atomize the fuel also mixes with the fuel spray and takes part in the combustion reaction; it therefore can be used to direct the spray in the optimum direction for mixing with additional air to obtain efficient combustion.

Figure 2:
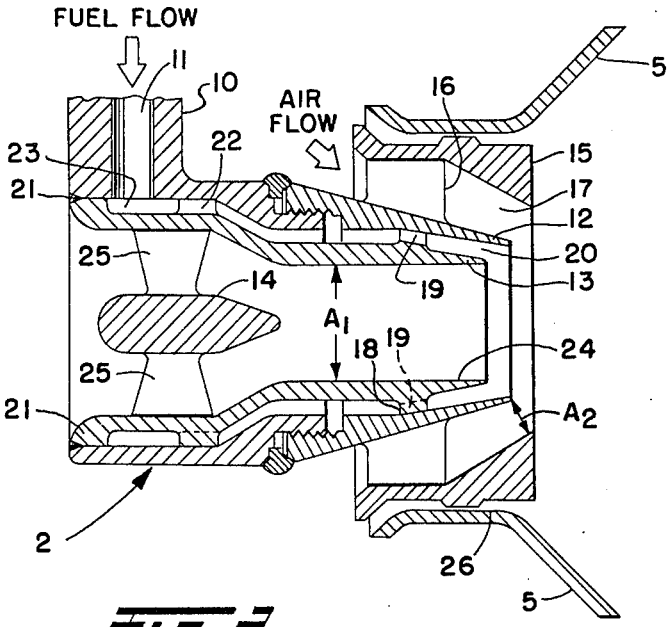
FIG. 2 is an enlarged cross-section view of a fuel nozzle according to the present invention.

FIG. 2 shows one embodiment of the invention, the installation of which will be understood from FIG. 1. The nozzle 2 comprises a holder 10 having a passage 11 drilled in its stem to carry the fuel from a fuel pump and control system (not shown). The holder 10 carries the nozzle tip which includes an outer air swirler 12, a fuel swirler 13, an inner air swirler 14, and a shroud 15. The outer air swirler 12 which carries swirler vanes 16 is threaded on to the holder 10 and locked by a circumferential weld as shown. The shroud 15 may be brazed to the outer edges of the swirl vanes 16 to define the outer annular air passage 17. The fuel swirler 13 has a rim or flange portion 18 which is formed with a number of swirl slots 19 disposed at an angle to the axis so that a fuel swirl chamber 20 is formed in conjunction with the part 12. The upstream end of part 13 is flanged at 21 and welded circumferentially to the holder 10 after bottoming the periphery of rim 18 into the interior cone of the air swirler 12. Additional spacing ribs are indicated at 22. Thus an annulus 23 is formed between parts 12 and 13, in communication with the drilled passage 11, to feed fuel into the swirl chamber 20.

The inner air swirler 14 may be brazed inside the fuel swirler 13 in the enlarged upstream region of the center air passage 24. It is a feature of the invention that the center air passage 24 is designed so that the cross sectional area for air flow from the point $A_1$ downstream is less than the effective flow area through the swirl vane assembly 14, the ratio being approximately 90 percent. The purpose of this feature is to eliminate the wakes downstream of each vane 25 and to produce a smooth air flow along the center tube having a transverse velocity profile which gives high air velocity at the walls. The same philosophy is employed in the outer air swirl passage 17, the area of the throat $A_2$ being less than the effective flow area of the swirl vane assembly 16, the ratio again being approximately 90 percent. The swirl vanes 16 and 25 in the outer and inner passages are designed to produce the desired air flow direction at exit from the nozzle 2; a typical value of the included angle of the conical air flow pattern being 80°. It will be understood that the angle and direction of rotation of the swirl are determined by the design of the combustor 4 and are not critical design features of the fuel nozzle 2.

The fuel nozzle 2 fits into an opening 26 in the combustion liner 5 and it will be understood, however, that the liner 5 may contain other features, such as air swirling devices or cooling air slots, which are not shown in FIG. 2 as they are not part of the present invention.

Figure 3:
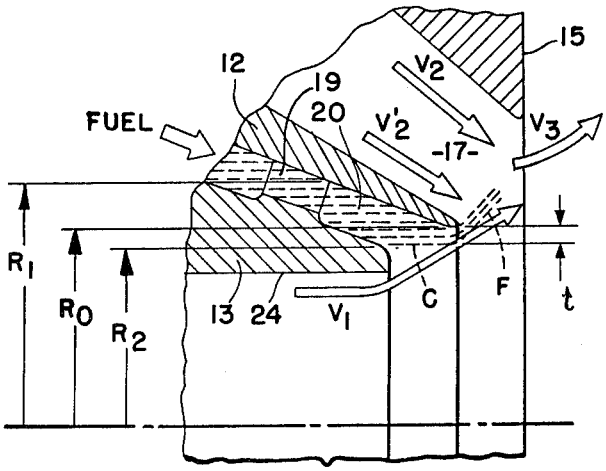
FIG. 3 is a further enlarged fragmentary cross-section of the tip of the FIG. 2 nozzle.

The operation of the fuel nozzle 2 can best be understood by reference to FIG. 3 which shows much enlarged portion of the fuel nozzle tip with the critical design features slightly exaggerated for clarity. The function of the fuel swirl chamber 20 is clearly shown as being to produce a rotating body of liquid which, as is well known, forms an inner surface C in contact with air, this being known conventionally as the "air core." At this surface C the static pressure of the liquid is equal to the static pressure of the air. The rotating body of liquid has the properties of a free vortex such that the tangential velocity at the air core is greater than the tangential velocity at the largest diameter of the fuel swirl chamber 20 in the ratio $R_1/R_2$. This acceleration of the liquid operates to smooth out variations in the velocity at the inlet to the swirl chamber 20 and gives constant velocity at the exit from the swirl chamber 20. The exit is of course defined by the circular lip of part 12 at a radius $R_0$ and the difference in radius $R_0$–$R_2$ determines the thickness of the liquid film F. As is well known, the thickness of the film is substantially invariant with the rate of liquid flow for a given set of dimensions of the swirl chamber 20 and a given liquid; by choice of suitable dimensions the film can be made very thin, for example if $R_0$=0.5 inches then the film thickness $t$=0.005 inches (approximately) for hydrocarbon fuels of viscosity less than 12 centistokes. It should be noted that this film will leave the swirl chamber 20 exit with a substantial tangential velocity and will therefore become an expanding conical sheet as shown in FIG. 3 at F.

Considering first the air flow from the inner passage 24 of FIG. 2, the outermost layer of air will leave the downstream edge of part 13 as an expanding cone at an angle indicated by the arrow $V_1$ of FIG. 3, the angle being predetermined by the design so that this layer of air strikes the fuel film substantially at the lip of part 12 i.e. at the point where the film is virtually unaffected by the metal surface of part 12. Thus, there is no prefilming of the fuel as previously described with reference to prior art.

The air flow in the outer passage 17 is shown generally as the arrow $V_2$ representing the inward direction of flow. The innermost layer of air, shown as the arrow $V_2'$, strikes the fuel sheet as it leaves the lip of part 12, the angle between the air flow direction and the surface of the fuel sheet approaching a right angle. It will be understood, however, that the tangential component of velocity in the outer air passage 17, due to the swirl vanes 16, will result in the air flow generally downstream of the nozzle following an expanding conical path indicated by the arrow $V_3$, substantially in the same direction as the arrow $V_1$. In practice it has been found advantageous to design the nozzle 2 so that the effective exit cone angle of the inner air is slightly less than that of the outer air to obtain optimum spray shape characteristics.

It will be realized that FIG. 3 is a conventional two-dimensional representation of a process which is in fact three-dimensional, but since the swirling or tangential component velocity only affects the relative angle at which the air streams approach the liquid film surface the atomization process is not basically affected by this consideration. It is well known that the mechanism of atomization or breakup of a liquid sheet into drops does not depend on the impact of air upon liquid in the ordinary sense; the breakup is due principally to the instability of the liquid sheet and its tendency to form waves due to the relative motion of the air. The waves, in turn, result in local differences in air pressure which tend to increase the wave amplitudes to a critical value at which the sheet disintegrates into ligaments, which in turn break up into drops. In the present invention, the fuel sheet is made very thin and of a constant initial thickness; it is then subjected to moving air on both sides, the air velocities being approximately equal on each side and free from local velocity variations which can be caused by wakes from swirl vanes or other obstructions.

The amount of air which is necessary to obtain good atomization has been determined to be close to equivalent mass flow rates of air and fuel, i.e. an air/fuel mass flow ratio of about 1. It has been found that atomization deteriorates rapidly if the ratio is less than about 0.5, but conversely there is little improvement for ratios in excess of about 4. The proportions of the atomizing air flow required on each side of the sheet are also not critical but a ratio of outer to inner mass flow rates between 1 and 2 gives optimum results.

Since, as mentioned previously, the atomizing air flow is a constant fraction of the total combustor air flow, while the ratio of fuel flow to the total air flow varies with engine power conditions, it follows that the ratio of atomizing air flow to fuel flow also varies with engine conditions. This results generally in the ratio of atomizing air flow to fuel flow being greater at the engine starting conditions, which is beneficial since it improves fuel atomization during the critical ignition and starting period. Due to this effect and also the absence of the prefilming disadvantages previously noted, the fuel nozzle 2 described herein does not need separate pilot or primary fuel nozzle means for starting as required by U.S. Pat. No. 3,283,502.

Figure 4:
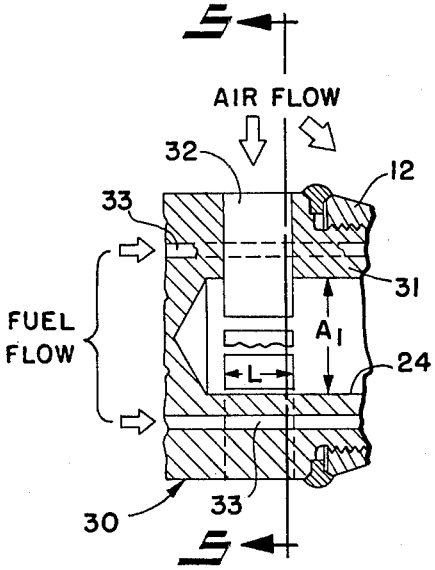
FIG. 4 is a cross-section view of a modified form of fuel nozzle.
Figure 5:
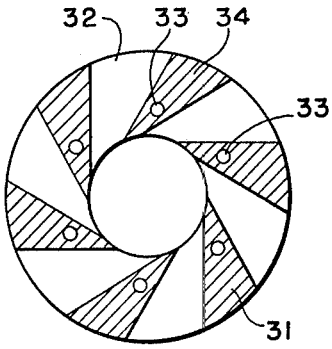
FIG. 5 is a transverse cross-section view along line 5—5, FIG. 4.

Another embodiment of the invention is shown in FIGS. 4 and 5. In this case the method of installing the fuel nozzle 30 in the combustor does not permit the use of axial swirl vanes 25 in the inner air passage 24 since the air must enter from the sides of the nozzle instead of from the upstream end of the nozzle tip as shown in FIG. 2. Parts which are the same as in FIG. 2 are given the same numbers in FIG. 4, and it is readily seen that the shroud 15 and the outer air swirler 12 are the same. The fuel swirler is now combined with the holder into one member 31 and the function of the inner air swirler is performed by slots 32 formed in the body 31 as shown in FIG. 5. Fuel is fed through drilled passages 33 which pass through the vanes 34. The internal passage 24 is not enlarged at its upstream end since the area for air flow through the slots 32 can readily be made greater than the area $A_1$. For vanes 34 which terminate essentially in sharp edges at the bore 24, the inlet area is equal to $A_1$ when the length L equals one-fourth of the diameter of passage 24, thus if $L=0.3\ x$ this diameter the ratio of $A_1$ to the inlet area will be 83 percent. It should be noted further that with this construction there are virtually no wakes from the swirl vanes.

In both embodiments of the invention herein, the center air passage 24 is of length from about one and one-half to two times its diameter to maximize air velocity and to insure a well-developed vortex flow by the time that the air reaches the downstream end of said center air passage 24. In the case of the axial flow swirler vane assembly 25, the upstream end portion of the center air passage 24 eliminates any residual air wakes which may carry beyond the small end of the tapered portion of the air swirling chamber and further removes the disruptive effect of the vena contracta in the swirling air stream as it enters the upstream end portion of said center air passage 24. In the case of radial in-flow of air into the swirl slots 32 of FIGS. 4 and 5 there are, as aforesaid, virtually no wakes from the vanes 34 nor is there the aforesaid vena contracta as in FIG. 2. However, the aforesaid length to diameter ratio of the center air passage 24 in FIG. 4 is of importance not only to eliminate whatever air wakes there may be due to the swirl vanes 34 but to insure maximized air velocity and a well-developed vortex flow from the downstream end of said center air passage 24.

Although it has been previously indicated that the areas $A_1$ and $A_2$ are approximately 90 percent of the effective flow areas of the respective vane assemblies 25 and 16, variation of such areas $A_1$ and $A_2$ can be tolerated to about 80 percent but with decreased mass flow rate of air.

The embodiments of the invention in which an exclusive property or priviledge is claimed are defined as follows:

1. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, and a central air passage within said fuel passage having swirl means and having a downstream end from which air is discharged as an expanding cone of predetermined angle, said discharge orifice being axially beyond the downstream end of said central air passage and being of diameter greater than that of the downstream end of said central air passage such that the outer layer of the expanding air cone impinges on the swirling fuel where it emerges as a conical fuel sheet from said discharge orifice.

2. The nozzle of claim 1 wherein said body assembly has an outer annular air passage which at its downstream end has its inner layer directed angularly toward the conical fuel sheet as it emerges from said discharge orifice.

3. The nozzle of claim 1 wherein said body assembly has an outer annular air passage which at its downstream end has its inner layer directed angularly toward the conical fuel sheet as it emerges from said discharge orifice; and wherein the air/fuel mass flow ratio is between about 0.5 and 4.

4. The nozzle of claim 1 wherein said body assembly has an outer annular air passage which at its downstream end has its inner layer directed angularly toward the conical fuel sheet as it emerges from said discharge orifice; and wherein the air velocities inside and outside the conical fuel sheet are approximately equal.

5. The nozzle of claim 1 wherein said body assembly has an outer annular air passage which at its downstream end has its inner layer directed angularly toward the conical fuel sheet as it emerges from said discharge orifice; and wherein the air/fuel mass flow ratio is about 1.

6. The nozzle of claim 5 wherein the ratio of outer to inner air mass flow rates is between 1 and 2.

7. The nozzle of claim 1 wherein said central air passage is of axial length of from about one and one-half to two times its diameter.

8. The nozzle of claim 1 wherein the flow area of said central air passage is approximately 90 percent of the effective flow area of said swirl means.

9. The nozzle of claim 2 wherein said outer annular air passage has swirl means for causing the air issuing from the downstream end of said outer annular air passage to follow a generally conical path in the region downstream of said discharge orifice; and wherein the flow areas of said central and outer annular passages are approximately 90 percent of the effective flow areas of the respective swirl means.

10. The nozzle of claim 1 wherein the flow area of said central air passage is between about 80 and 90 percent of the effective flow area of said swirl means.

11. The nozzle of claim 2 wherein said outer annular air passage has swirl means for causing the air issuing from the downstream end of said outer annular air passage to follow a generally conical path in the region downstream of said discharge orifice; and wherein the flow areas of said central and outer annular passages are between about 80 and 90 percent of the effective flow areas of the respective swirl means.

12. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, a central air passage within said fuel passage having swirl means and having a downstream end from which air is discharged as an expanding cone of predetermined angle to impinge on the conical fuel sheet as it emerges from said discharge orifice; and an outer annular air passage having swirl means and having a downstream end from which the inner layer of air is directed angularly toward the conical fuel sheet as it emerges from said discharge orifice, the air passages and discharge orifice providing an air/fuel mass flow ratio between about 0.5 and 4.

13. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, a central air passage within said fuel passage having swirl means and having a downstream end from which air is discharged as an expanding cone of predetermined angle to impinge on the conical fuel sheet as it emerges from said discharge orifice, and an outer annular air passage having swirl means and having a downstream end from which the inner layer of air is directed angularly toward the conical fuel sheet as it emerges from said discharge orifice, the air velocities from the downstream ends of said central air passage and annular air passage being approximately equal.

14. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, a central air passage within said fuel passage having swirl means and having a downstream end from which air is discharged at an expanding cone of predetermined angle to impinge on the conical fuel sheet as it emerges from said discharge orifice, and an outer annular air passage having swirl means and having a downstream end from which the inner layer of air is directed angularly toward the conical fuel sheet as it emerges from said discharge orifice, the air passages and discharge orifice providing an air/fuel mass flow ratio of about 1.

15. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, a central air passage within said fuel passage having swirl means and having a downstream end from which air is discharged as an expanding cone of predetermined angle to impinge on the conical fuel sheet as it emerges from said discharge orifice, and an outer annular air passage having swirl means and having a downstream end from which the inner layer of air is directed angularly toward the conical fuel sheet as it emerges from said discharge orifice; the ratio of mass flow rate of air from said annular air passage and said central air passage being between 1 and 2.

16. An air-atomizing fuel nozzle comprising a nozzle body assembly defining therewithin a fuel passage having a discharge orifice at its downstream end and having a vortex chamber to impart a whirling motion to the fuel flowing through said passage for discharge from said discharge orifice in the form of a conical sheet, a central air passage within said fuel passage having swirl means and having a downstream end from which air is discharged as an expanding cone of predetermined angle to impinge on the conical fuel sheet as it emerges from said discharge orifice, and an outer annular air passage having swirl means and having a downstream end from which the inner layer of air is directed angularly toward the conical fuel sheet as it emerges from said discharge orifice, said central air passage being of axial length of from about one and one-half to two times its diameter.

17. The nozzle of claim 16 wherein said central air passage has a flow area less than the effective flow area of its swirl means.

18. The nozzle of claim 16 wherein said central air passage has a flow area approximately 90 percent of the effective flow area of its swirl means.

19. The nozzle of claim 16 wherein said central air passage has a flow area between 80 and 90 percent of the effective flow area of its swirl means.

* * * * *